US010280043B2

(12) United States Patent
Salminen

(10) Patent No.: US 10,280,043 B2
(45) Date of Patent: May 7, 2019

(54) SUPPORT APPARATUS FOR AN ELEVATOR CAR

(71) Applicant: Jouko Salminen, Riihimaki (FI)

(72) Inventor: Jouko Salminen, Riihimaki (FI)

(73) Assignee: Kone Corporation, Helsinki (FI)

( * ) Notice: Subject to any disclaimer, the term of this patent is extended or adjusted under 35 U.S.C. 154(b) by 318 days.

(21) Appl. No.: 15/010,707

(22) Filed: Jan. 29, 2016

(65) Prior Publication Data

US 2016/0159617 A1 Jun. 9, 2016

Related U.S. Application Data

(63) Continuation of application No. PCT/FI2014/050576, filed on Jul. 14, 2014.

(30) Foreign Application Priority Data

Aug. 22, 2013 (EP) ..... 13181341

(51) Int. Cl.
*B66B 17/34* (2006.01)
*B66B 5/00* (2006.01)
*B66B 5/28* (2006.01)

(52) U.S. Cl.
CPC ..... *B66B 17/34* (2013.01); *B66B 5/0075* (2013.01); *B66B 5/28* (2013.01)

(58) Field of Classification Search
CPC ..... B66B 17/34; B66B 5/0075; B66B 5/28
See application file for complete search history.

(56) References Cited

U.S. PATENT DOCUMENTS 823,455 A * 6/1906 Willcox ..... B66B 1/14 187/281
889,833 A * 6/1908 Wallingford ..... B66B 5/26 187/344

(Continued)

FOREIGN PATENT DOCUMENTS

CN 1034323 C 3/1997
CN 1158318 A 9/1997

(Continued)

OTHER PUBLICATIONS

Chinese Office Action dated Sep. 5, 2016 issued in corresponding Chinese Application No. 201480046305.4 (no English translation).

(Continued)

*Primary Examiner* — Michael A Riegelman
(74) *Attorney, Agent, or Firm* — Harness, Dickey & Pierce, P.L.C.

(57) ABSTRACT

The invention relates to a support apparatus for an elevator car. The support apparatus comprises a support block for attaching to a sidewall of an elevator hoistway, the support block having an oblique surface. The support apparatus also comprises a sliding plate for mounting to the elevator car. The sliding plate is movable between an extended position and a retracted position. The sliding plate has an oblique surface facing the oblique surface of the support block when the sliding plate is in the extended position. The sliding plate is slideable over the oblique surface of the support block when being moved from the extended position to the retracted position. The support apparatus also comprises an actuator shaft attached to the sliding plate and an actuator configured to move the sliding plate using the actuator shaft from the extended position to the retracted position. The actuator is attachable to the elevator car.

18 Claims, 4 Drawing Sheets

(56) References Cited

U.S. PATENT DOCUMENTS

| | | | | | |
|---|---|---|---|---|---|
| 922,375 | A * | 5/1909 | Wright | B66B 17/34 | 187/358 |
| 953,297 | A * | 3/1910 | Sautter | B66B 17/34 | 187/331 |
| 1,209,361 | A * | 12/1916 | Tonielli | B66B 5/28 | 187/343 |
| 1,773,163 | A * | 8/1930 | Becker | B66B 17/34 | 187/360 |
| 1,896,362 | A * | 2/1933 | Holmes | B66B 17/34 | 187/357 |
| 2,316,976 | A * | 4/1943 | Sahlin | B66B 17/34 | 187/360 |
| 2,848,069 | A * | 8/1958 | Sanders | B66B 17/34 | 187/360 |
| 3,674,117 | A * | 7/1972 | Sjostrom | B66B 5/28 | 187/343 |
| 5,411,117 | A * | 5/1995 | Hayrinen | B66B 5/26 | 187/345 |
| 5,713,434 | A * | 2/1998 | Sun | B66B 5/16 | 187/360 |
| 5,771,995 | A * | 6/1998 | Cooney | B66B 11/006 | 187/356 |
| 6,805,223 | B2 * | 10/2004 | Maury | B66B 5/18 | 187/343 |
| 8,453,800 | B2 * | 6/2013 | Tolonen | B66B 5/0056 | 187/357 |
| 9,777,755 | B2 * | 10/2017 | Lowe | F15B 15/26 | |

FOREIGN PATENT DOCUMENTS

| | | | |
|---|---|---|---|
| CN | 101903275 | A | 12/2010 |
| EP | 0578238 | A1 | 1/1994 |
| FR | 2628403 | A1 | 9/1989 |
| GB | 855690 | A | 12/1960 |
| JP | S50150074 | U | 12/1975 |
| JP | 2008044782 | A | 2/2008 |
| JP | 2009096561 | A | 5/2009 |
| WO | WO-2011146073 | A1 | 11/2011 |

OTHER PUBLICATIONS

International Search Report PCT/ISA/210 for International Application No. PCT/FI2014/050576 dated Nov. 11, 2014.

* cited by examiner

SUPPORT APPARATUS FOR AN ELEVATOR CAR

This application is a continuation of PCT International Application No. PCT/FI2014/050576 which has an International filing date of Jul. 14, 2014, and which claims priority to European patent application number 13181341.2 filed Aug. 22, 2013, the entire contents of both of which are incorporated herein by reference.

BACKGROUND OF THE INVENTION

Field of the Invention

The invention relates to hoisting machines, and particularly to heavy load hoisting machines. Particularly, the invention relates to a support apparatus for an elevator car.

Description of the Related Art

Freight elevators, that is, good elevators may be capable of carrying a heavy load, for example, up to several metric tons. Freight elevators may also be loaded using a forklift or other type of vehicle which temporarily boards the elevator for loading purposes. This leads to variation in the elevator load during loading and imposes special stability requirements for freight elevators. Freight elevators may be hydraulic elevators in some cases, but they may also be traction elevators, which employ a traction sheave to drag traction means. The traction means may be ropes. Any quick variations in the load during the loading process may cause that the elevator cage starts bouncing on the traction ropes. The degree of bouncing depends on the elasticity of the traction ropes. Freight elevators may be equipped with loading bolts which ensure that the elevator car does not move or bounce while the elevator is being loaded. The principle of the loading bolts is that they are extended while the elevator car is on a landing. A landing may be a floor, a platform, a bridge or any other a level at which the elevator car may be loaded or unloaded. The elevator car rests on the loading bolts 35 which prevent the bouncing of the elevator car on the traction ropes. The loading bolts may be flat and perpendicular in relation to the elevator shaft wall. In order to be able to retract the loading bolts, the elevator car must be driven off the landing, that is, for example, a floor. This means that the elevator car is hoisted by the traction ropes a height that enables the retraction of the loading bolts so that the loading bolts do not touch the plane on which they rested while still on the floor. Otherwise, a friction between the bolts and the resting plane would prevent the retracting of the bolts. The requirement to drive the elevator car off the landing causes a delay after a visit in any landing such as a floor, which in turn increases the time for the elevator car to travel between any two landings. Additionally, when the elevator car is driven off a landing, the traction ropes tighten and cause a sudden acceleration of the elevator car which may lead damage to sensitive equipment on board the elevator car and which otherwise may be perceived unpleasant for persons on board the elevator car.

A problem with the existing loading bolts is the need to drive the elevator car off the landing in order to the able to retract the loading bolts. The separate step of driving the elevator car off each landing where the loading bolts have been deployed also complicates the designing of elevator control software. An additional problem is the sudden acceleration of the elevator car when the traction ropes begin to pull the elevator car. Therefore, it would be beneficial to have a solution that does not necessitate the specific step of driving the elevator car off the loading landing.

SUMMARY OF THE INVENTION

According to an aspect of the invention, the invention is a support apparatus for an elevator car, the support apparatus comprising: a sliding plate configured to be mounted to the elevator car, the sliding plate being movable between an extended position and a retracted position, the sliding plate having an oblique surface configured to face an oblique surface of a support block attached to an elevator hoistway when the sliding plate is in the extended position, the support block having an oblique surface, the sliding plate being slideable over the oblique surface of the support block when being moved from the extended position to the retracted position; and an actuator configured to be mounted to the elevator car, the actuator being configured to move the sliding plate from the extended position to the retracted position and from the retracted position to the extended position.

According to a further aspect of the invention, the invention is an elevator comprising a support apparatus for an elevator car of the elevator. The support apparatus comprises: a sliding plate configured to be mounted to the elevator car, the sliding plate being movable between an extended position and a retracted position, the sliding plate having an oblique surface configured to face an oblique surface of a support block attached to an elevator hoistway when the sliding plate is in the extended position, the support block having an oblique surface, the sliding plate being slideable over the oblique surface of the support block when being moved from the extended position to the retracted position, and an actuator configured to be mounted to the elevator car, the actuator being configured to move the sliding plate from the extended position to the retracted position and from the retracted position to the extended position; and the support block attached to an elevator hoistway.

According to a further aspect of the invention, the invention is an elevator comprising the support apparatus.

In one embodiment of the invention, the support block is mounted or attached to a sidewall of the elevator hoistway.

In one embodiment of the invention, there may be at least two support apparatuses and at least two support blocks. The support blocks may be mounted on mutually opposite sides of the elevator hoistway. There may be at least two support blocks mounted to the elevator shaft on the one side of the elevator shaft and at least two support blocks mounted to the elevator shaft on the other, for example, the opposite side of the elevator shaft. For each support block there may be a respective support apparatus.

In one embodiment of the invention, the support apparatus further comprises an actuator shaft attached to the sliding plate and wherein the actuator is configured to move the sliding plate using the actuator shaft from the extended position to the retracted position and from the retracted position to the extended position.

In one embodiment of the invention, the actuator, the actuator shaft and the sliding plate are mounted below the elevator car. The actuator, the actuator shaft and the sliding plate may be attached below a floor of the elevator car or elevator car assembly. The actuator, the actuator shaft and the sliding plate may be attached below or above any horizontal member of the elevator car or an elevator car assembly.

In one embodiment of the invention, an angle of the oblique surface of the support block is substantially an adjacent angle of an angle of the oblique surface of the sliding plate. The sum of the angle and the adjacent angle is 180 degrees. The adjacent angle may be seen between a lower surface of the sliding plate and the oblique surface of the sliding plate.

In one embodiment of the invention, an angle between the oblique surface of the support block and a horizontal plane is substantially same as an angle between the oblique surface of the sliding plate and a horizontal plane. The angles may be determined when the support block is attached to the sidewall of the elevator shaft and the sliding plate is installed to the elevator car, for example, supported by an actuator shaft and an actuator.

In one embodiment of the invention, the angle of the oblique surface of the support block is between 25 degrees and 65 degrees. The angle may be between a horizontal plane and the oblique surface of the support block.

In one embodiment of the invention, the actuator is a hydraulic cylinder. The hydraulic cylinder may be pressurized with a hydraulic pump via at least one pipe. The actuator shaft may be a piston rod of the hydraulic cylinder.

In one embodiment of the invention, the actuator is a spindle motor. The actuator shaft may be the spindle of the spindle motor.

In one embodiment of the invention, on the oblique surface of the support block is attached a slide plate. The slide plate may have a coating to reduce friction. The slide plate may be coated or covered with plastic plate or layer. The plastic can be, for example, Nylon.

In one embodiment of the invention, the support apparatus further comprises: a mounting brace for attaching the support block to the sidewall of the elevator hoistway.

In one embodiment of the invention, a height of the support block is adjustable in relation to the mounting brace.

In one embodiment of the invention, an upper portion of the mounting brace has a slit for bolts to fix the support block to a desired height.

In one embodiment of the invention, the sliding plate comprises at least one wheel for reducing friction in a contact surface between the sliding plate and the elevator car while the sliding plate is moved between the extended position and the retracted position.

In one embodiment of the invention, the elevator car is comprised in a traction elevator.

In one embodiment of the invention, the traction is based on at least one of a rope and a belt, for example, being pulled by a traction sheave.

In one embodiment of the invention, the elevator car is comprised in a freight elevator.

In one embodiment of the invention, the elevator is a traction elevator.

In one embodiment of the invention, the actuator is attached to a floor or any other horizontal member of the elevator car or an elevator car assembly.

In one embodiment of the invention, at least one of the sliding plate and the actuator shaft are supported from the elevator car.

In one embodiment of the invention, the traction means comprises a plurality of ropes. On the traction sheave may be a plurality of grooves for the plurality of ropes.

In one embodiment of the invention, the traction means comprises at least one belt.

In one embodiment of the invention, the elevator car may also be referred to as elevator cage. The elevator car may be elevator cage.

In one embodiment of the invention, the traction means comprises a plurality of ropes. On the traction sheave may be a plurality of grooves for the plurality of ropes.

In one embodiment of the invention, the traction means comprises at least one belt.

The embodiments of the invention described hereinbefore may be used in any combination with each other. At least two of the embodiments may be combined together to form a further embodiment of the invention. A support apparatus and an elevator to which the invention is related may comprise at least one of the embodiments of the invention described hereinbefore.

It is to be understood that any of the above embodiments or modifications can be applied singly or in combination to the respective aspects to which they refer, unless they are explicitly stated as excluding alternatives.

The benefits of the invention are related to a reduced travel time for the elevator car to travel between landings. Further benefits may relate to simplicity for implementing elevator control system for the elevator due to the lack of a need for a separate step to drive off a landing such as a floor. Further benefits may relate to reduced noise and increased smoothness in elevator car movement.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE EMBODIMENTS

Reference will now be made in detail to the embodiments of the present invention, examples of which are illustrated in the accompanying drawings.

Figure 1:
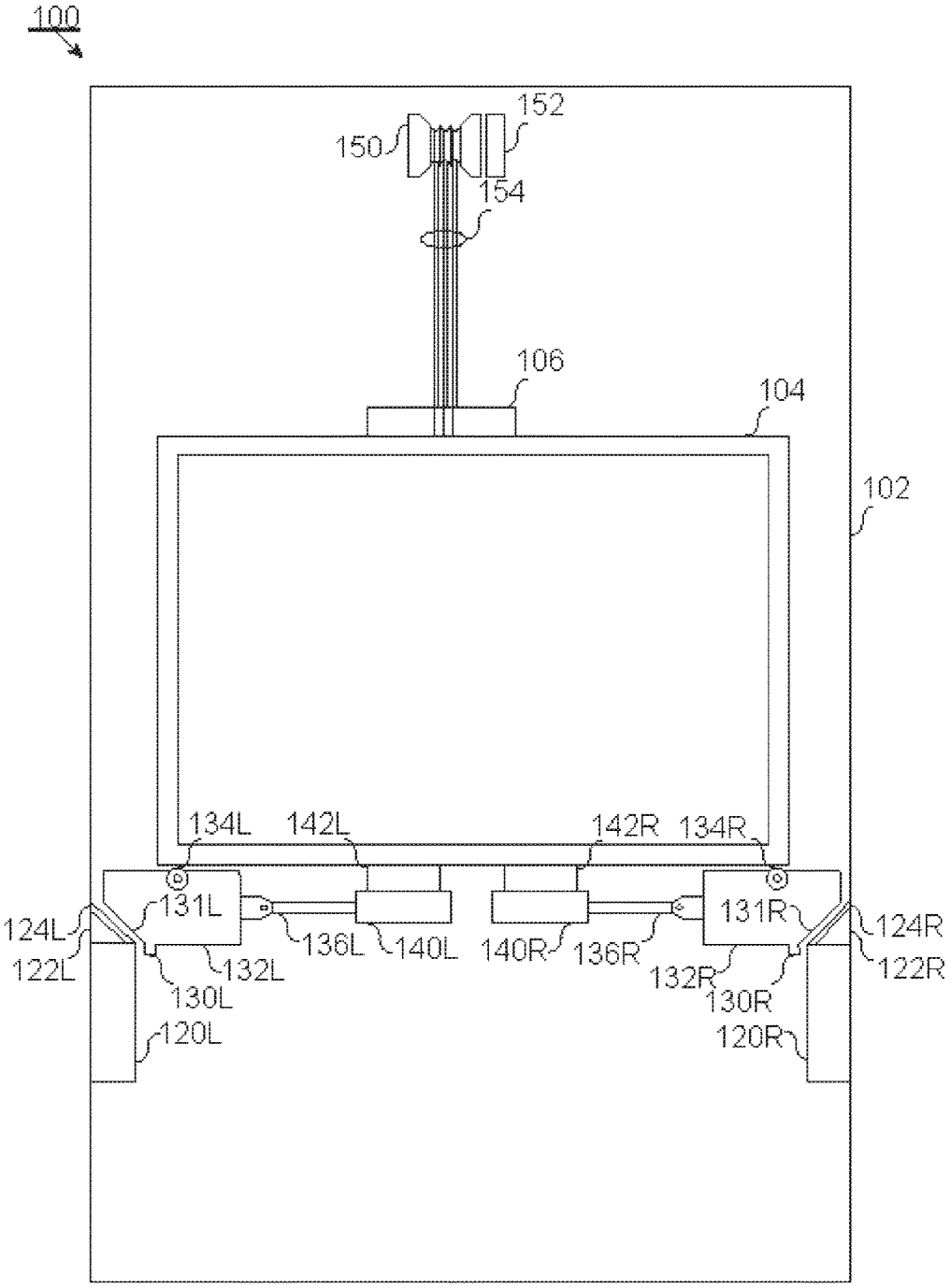
FIG. 1 illustrates an elevator equipped with at least two elevator car support devices in one embodiment of the invention.

FIG. 1 illustrates an elevator equipped with at least two elevator car support devices in one embodiment of the invention. In FIG. 1 there is illustrated an elevator hoistway, that is, an elevator shaft 102. The elevator shaft may also be referred to as elevator hoistway. In FIG. 1 there is an elevator car 104. Elevator car 104 may also be referred to as an elevator cage. Elevator car is hoisted by ropes 154 or by other traction means such as a traction belt. Ropes 154 or the other tractions means are pulled using a traction sheave 150. The traction sheave may be spun using an electrical motor 152. Ropes 154 or the other tractions means are connected to a counterweight 106 from their other ends. In FIG. 1 underneath elevator car 104 there is shown a left hand side support 142L which supports a hydraulic cylinder 140L. Hydraulic cylinder is used to actuate a piston (not shown) and thereby a piston rod 136L. Similarly, underneath elevator car 104 there is shown a right hand side support 142R which supports a hydraulic cylinder 140R. Hydraulic cylinder 140R is used to actuate a piston (not shown) and a piston rod 136R. A spindle motor may substitute for hydraulic cylinder 140L in one embodiment of the invention. In this case a spindle of the spindle motor may substitute for piston rod 136L. Similarly, a spindle motor may substitute for hydraulic cylinder 140R in one embodiment of the invention. In this case a spindle of the spindle motor may substitute for piston rod 136R.

To piston rod 136L is connected a sliding wedge plate 132L. Sliding wedge plate has an oblique surface 131L. Sliding wedge plate also has a tenon 130L portion. Tenon portion 130L may be located at the lower end of the oblique surface 131L. Sliding wedge plate 132L has an opening in an upper portion of sliding wedge plate 132L that allows an axel for wheel 134L to be fitted through the opening. Wheel 134L is sized to allow sliding wedge plate 132L to move between an extended position and a retracted position below elevator car 104 so that an upper surface of sliding wedge plate 132L does not drag against a floor or any other horizontal support structure of elevator car 104. There may be a plurality of similar openings in sliding wedge plate 132L for a plurality of wheels.

Similarly, to piston 136R is connected a sliding wedge plate 132R. Sliding wedge plate has an oblique surface 131R. Sliding wedge plate also has a tenon 130R portion. Tenon portion 130R may be located at the lower end of the oblique surface 131R. Oblique surfaces 131L and 131R may be seen as mirror images of one another. Similarly, sliding wedge plate 132R has an opening in an upper portion of sliding wedge plate 132R that allows an axel for wheel 134R to be fitted through the opening. There may be a plurality of similar openings in sliding wedge plate 132R for a plurality of wheels.

The purpose of tenon portions 130L and 130R is to prevent a lateral movement of elevator car 104, while elevator car is supported on sliding wedge plates 132L and 132R. Tenon portion 130L of sliding wedge plate 132L prevents elevator car 104 to move to the left, while tenon portion 130R of sliding wedge plate 132R prevents elevator car 104 to move to the right.

Oblique surface 131L of sliding wedge plate 132L rests on a support block 122L when oblique slide plate 132L is in extended position. Similarly, oblique surface 131R of sliding wedge plate 132R rests on a support block 122R when oblique slide plate 132R is in extended position. Support blocks 122L and 122R have oblique surfaces that face the respective oblique surfaces 131L and 131R of respective sliding wedge plates 132L and 132R. Support blocks 122L and 122R are fixed to walls of elevator shaft 102 using respective mounting braces 120L and 120R. On the oblique surfaces of support blocks 122L and 122R are fixed respective slide plates 124L and 124R. Slide plates 124L and 124R may be made out of steel. Slide plates 124L and 124R may be coated or covered with plastic plate or layer. The plastic can be, for example, Nylon.

When hydraulic piston rods 136L and 136R are being used to retract respective sliding wedge plates 132L and 132R, sliding wedge plates 132L and 132R and elevator car 104 start sliding downwards on oblique surfaces of support blocks 122L and 122R. With increased retraction of sliding wedge plates 132L and 132R there is increased room for downward movement of sliding wedge plates 132L and 132R on oblique surfaces of support blocks 122L and 122R. The downward movement of elevator car 104 causes the tightening of ropes 154 or other traction means. When the traction is started with ropes 154 or other traction means, the movement of elevator car 104 is now smoother.

In one embodiment of the invention, oblique support blocks 122L and 122R are adjustably mounted in respective mounting braces 120L and 120R. Support blocks 122L and 122R may have a plurality of openings with internal threads to fit bolts with external threads. In one embodiment of the invention, mounting brace 120L has at least one respective vertical slit. The vertical slit allows the height of a support block within the mounting brace to be adjusted. The vertical slit allows the fixing of a support block at a specific height with respect to the mounting brace.

Figure 2:
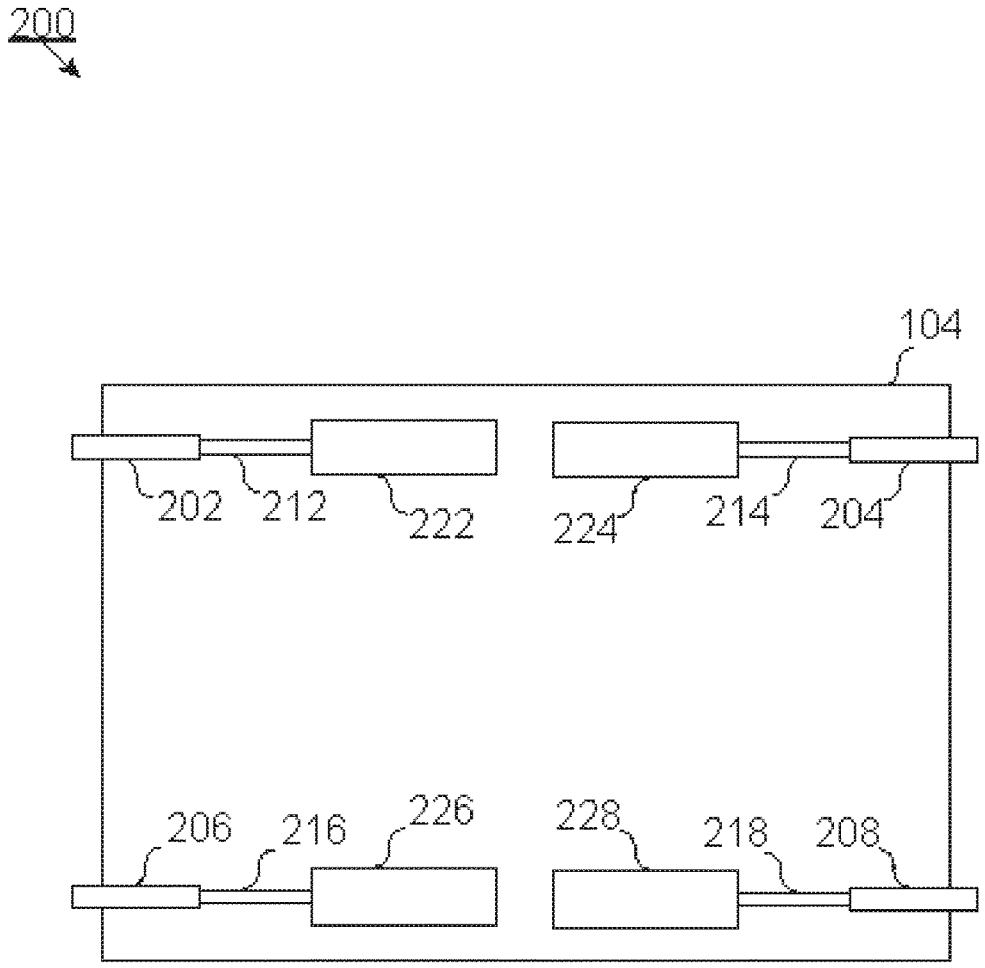
FIG. 2 illustrates an elevator car equipped with four elevator car support devices in one embodiment of the invention.

FIG. 2 illustrates an elevator car equipped with four elevator car support devices in one embodiment of the invention.

In FIG. 2 there is an arrangement 200 comprising four sliding wedge plates that may be extended and retracted. In FIG. 2 there are shown hydraulic cylinders 222, 224, 226 and 228. Hydraulic cylinders 222, 224, 226 and 228 are used to actuate respective piston rods 212, 214, 216 and 218. Piston rods 212, 214, 216 and 218 are used to extend or retract respective sliding wedge plates 202, 204, 206 and 208. Sliding wedge plates may correspond to sliding wedge plates shown in FIG. 1. For clarity purposes in FIG. 2 there are not shown the oblique support blocks corresponding to sliding wedge plates 202, 204, 206 and 208. Instead of hydraulic cylinders 222-228 may be used spindle motors so that spindles of the spindle motors substitute for hydraulic pistons 212-218. Sliding wedge plates 202, 204, 206 and 208 are located within a distance from respective corners of elevator car 104. The distance introduces a balance for elevator car 104 when sliding wedge plates 202, 204, 206 and 280 rest on their respective oblique support blocks.

Figure 3A:
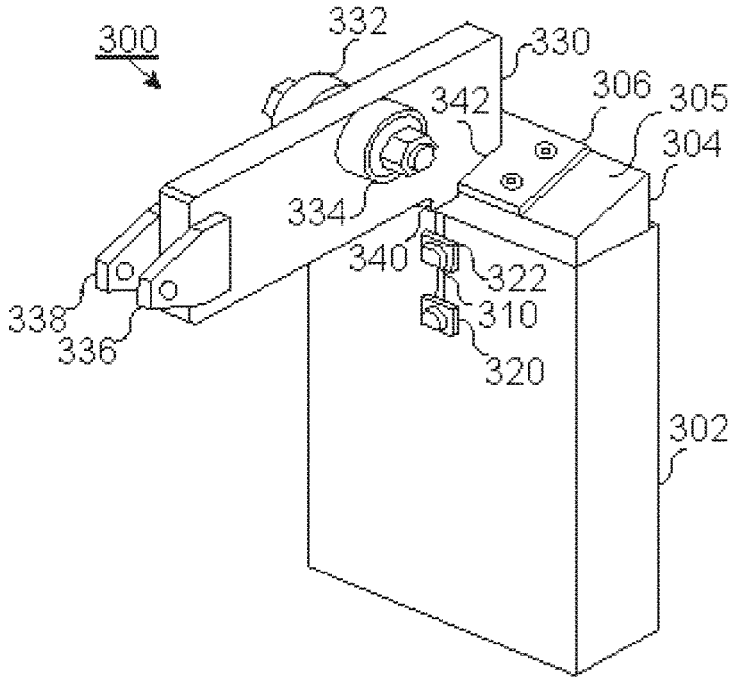
FIG. 3A illustrates an elevator car support device viewed from front in one embodiment of the invention.

FIG. 3A illustrates an elevator car support device 300 viewed from front in one embodiment of the invention.

In FIG. 3A there is shown a mounting brace 302. Mounting brace 302 may be attached to elevator shaft wall (not shown) using bolts (not shown) or by welding, for example, to a supporting steel girder (not shown). Mounting brace 302 may be a steel U-profile girder or stud. The U-profile is seen by viewing the stud from above as familiar to a person skilled in the art. The U-profile may allow placing a lower portion of support block 304 inside mounting brace 302. Mounting brace 302 has a vertical slit 310 which allows vertical movement of support block 304 in relation to mounting brace 302. Vertical slit 310 may be used to set support block 304 to a height that corresponds to a correct position of an elevator car on a landing, that is, for example, in a floor. A plurality of support blocks corresponding to support block 304 may be similarly set to a height that corresponds to the correct position of the elevator car on the landing, for example, in a floor. For example, there may be four support blocks such as support block 304. Support block 304 is secured to a correct height in relation to mounting brace 302 by tightening bolts 320 and 322 protruding through slit 310 to corresponding holes in a lower portion of support block (not shown) with internal threads. The lower portion may be narrowed than an upper portion of support block 304 so that the lower portion fits behind mounting brace 302. Support block 304 has an oblique surface 305 on which a slide plate 306 is fixed. In FIG. 3A over plate 306 is shown sliding wedge plate 330. A lower surface of sliding wedge plate 330 has a tenon portion 340.

Figure 3B:
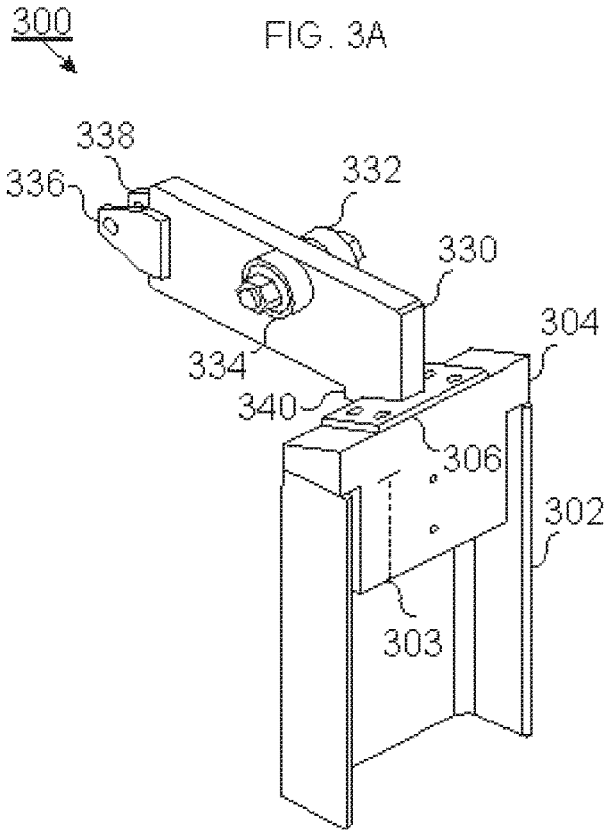
FIG. 3B illustrates an elevator car support device viewed from behind in one embodiment of the invention.

The lower surface of sliding wedge plate 330 also has an oblique surface 342. Oblique surface 342 has an angle which is similar to an angle of oblique surface 305. Slide plate 306 and support block 304 may be seen to fit a nook formed by oblique surface 342 and tenon portion 340. On an upper portion of sliding plate 330 there are fixed two wheels, that is, wheel 332 and wheel 334. To the end of sliding plate 330 facing a hydraulic piston rod (not shown) or a spindle or a spindle motor (not shown), there are fixed brace pieces 336 and 338 to which a piston rod or a spindle or a spindle motor may be attached FIG. 3B illustrates an elevator car support device viewed from behind in one embodiment of the invention. In FIG. 3B is shown the empty space behind mounting brace 302 which allows the height adjustment of support block 304 so that a lower portion 303 is at least partly inserted in the empty space.

Figure 4:
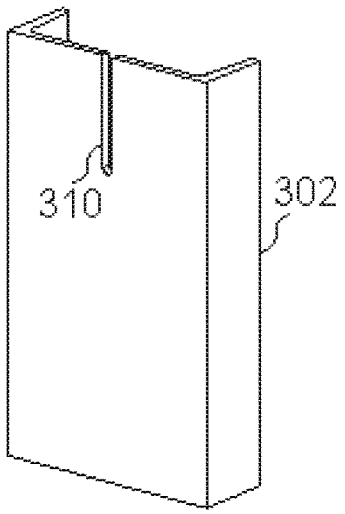
FIG. 4 illustrates an elevator car support device U-shaped stud in one embodiment of the invention.

FIG. 4 illustrates an elevator car support device U-shaped stud in one embodiment of the invention. The U-shaped stud may be similar to mounting brace 302 in FIGS. 3A and 3B. FIG. 4 shows slit 310 which allows height adjustable attaching of support block 304 to mounting brace 302 using bolts or other tightening means.

Figure 5:
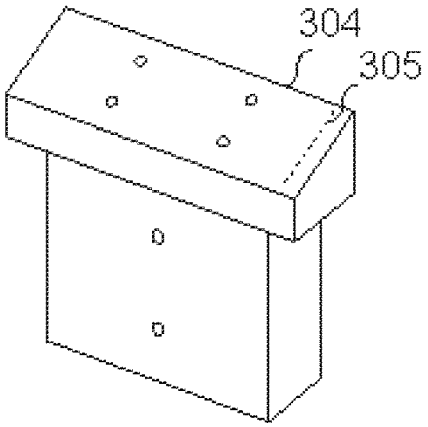
FIG. 5 illustrates an elevator car support device height adjustable support piece in one embodiment of the invention.

FIG. 5 illustrates an elevator car support device height adjustable support piece in one embodiment of the invention. In FIG. 5 there is shown support block 304 of FIGS. 3A and 3B. The support block has oblique surface 305.

Figure 6:
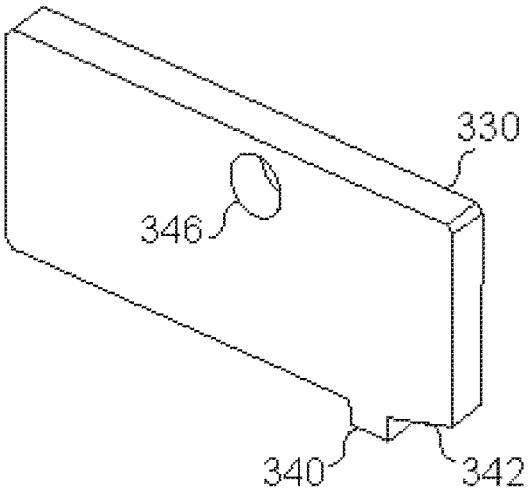
FIG. 6 illustrates an elevator car support device sliding plate in one embodiment of the invention.

FIG. 6 illustrates an elevator car support device sliding plate in one embodiment of the invention. The sliding plate is similar to sliding plate 330 in FIGS. 3A and 3B. FIG. 6 shows opening 346 for inserting an axis for wheels 332 and 334.

The embodiments of the invention described hereinbefore in association with FIGS. 1, 2, 3 and 4 and the summary of the invention may be used in any combination with each other. At least two of the embodiments may be combined together to form a further embodiment of the invention.

It is to be understood that the exemplary embodiments are for exemplary purposes, as many variations of the specific hardware used to implement the exemplary embodiments are possible, as will be appreciated by those skilled in the hardware art(s). For example, the functionality of one or more of the components of the exemplary embodiments can be implemented via one or more hardware devices, or one or more software entities such as modules.

While the present inventions have been described in connection with a number of exemplary embodiments, and implementations, the present inventions are not so limited, but rather cover various modifications, and equivalent arrangements, which fall within the purview of prospective claims.

The embodiments of the invention described hereinbefore in association with the figures presented and the summary of the invention may be used in any combination with each other. Several of the embodiments may be combined together to form a further embodiment of the invention.

It is obvious to a person skilled in the art that with the advancement of technology, the basic idea of the invention may be implemented in various ways. The invention and its embodiments are thus not limited to the examples described above; instead they may vary within the scope of the claims.

The invention claimed is:

1. A support apparatus for an elevator car, the support apparatus comprising:

a sliding plate configured to be mounted to the elevator car, the sliding plate being movable between an extended position and a retracted position, the sliding plate having an oblique surface configured to face an oblique surface of a support block attached to an elevator hoistway when the sliding plate is in the extended position, the support block having the oblique surface, the oblique surface being oblique in comparison to a horizontal plane, the oblique surface being angled relative to the horizontal plane such that an upper portion of the oblique surface is further outward in comparison to a center of the elevator car than a lower portion of the oblique surface, the sliding plate being arranged such that the sliding plate slides over the oblique surface of the support block when being moved from the extended position to the retracted position; and an actuator configured to be mounted to the elevator car, the actuator being configured to move the sliding plate from the extended position to the retracted position and from the retracted position to the extended position.

2. The support apparatus according to claim 1, wherein the support apparatus further comprises an actuator shaft attached to the sliding plate and wherein the actuator is configured to move the sliding plate using the actuator shaft from the extended position to the retracted position and from the retracted position to the extended position.

3. The support apparatus according to claim 1, wherein an angle between the oblique surface of the support block and the horizontal plane is substantially same as an angle between the oblique surface of the sliding plate and the horizontal plane.

4. The support apparatus according to claim 2, wherein an angle of the oblique surface of the support block relative to the horizontal plane is between 25 degrees and 65 degrees.

5. The support apparatus according to claim 1, wherein the actuator is a hydraulic cylinder.

6. The support apparatus according to claim 1, wherein on the oblique surface of the support block is attached a slide plate.

7. The support apparatus according to claim 1, wherein the support apparatus further comprises:

a mounting brace for attaching the support block to a sidewall of the elevator hoistway.

8. The support apparatus according to claim 7, wherein a height of the support block is adjustable in relation to the mounting brace.

9. The support apparatus according to claim 8, wherein an upper portion of the mounting brace has a slit for bolts to fix the support block to a desired height.

10. The support apparatus according to claim 1, wherein the elevator car is comprised in a traction elevator.

11. The support apparatus according to claim 1, wherein the sliding plate comprises a tenon to prevent movement of the sliding plate further towards the support block while the sliding plate is in the extended position.

12. The support apparatus according to claim 1, wherein the elevator car is comprised in a freight elevator.

13. The support apparatus according to claim 1, wherein the support block is attached to a sidewall of the elevator hoistway.

14. An elevator comprising:

at least two support apparatuses according to claim 1; and at least two the support blocks attached to the elevator hoistway.

15. The elevator according to claim 14, wherein the elevator is a traction elevator.

16. The elevator according to claim 14, wherein the actuator is attached to a floor or any other horizontal member of the elevator car.

17. The elevator according to claim 14, wherein at least one of the sliding plate and an actuator shaft are supported from the elevator car.

18. A support apparatus for an elevator car, the support apparatus comprising:

a sliding plate configured to be mounted to the elevator car, the sliding plate being movable between an extended position and a retracted position, the sliding plate having an oblique surface configured to face an oblique surface of a support block attached to an elevator hoistway when the sliding plate is in the extended position, the support block having the oblique surface, the oblique surface being oblique in comparison to a horizontal plane, the oblique surface being angled relative to the horizontal plane such that an upper portion of the oblique surface is further outward in comparison to a center of the elevator car than a lower portion of the oblique surface, the sliding plate being slideable over the oblique surface of the support block when being moved from the extended position to the retracted position; and an actuator configured to be mounted to the elevator car, the actuator being configured to move the sliding plate from the extended position to the retracted position and from the retracted position to the extended position, wherein the sliding plate comprises at least one wheel for reducing friction in a contact surface between the sliding plate and the elevator car while the sliding plate is moved between the extended position and the retracted position.

* * * * *